United States Patent [19]

Bunnell et al.

[11] 4,174,622

[45] Nov. 20, 1979

[54] AUTOMATIC WASHER SUSPENSION SYSTEM

[75] Inventors: Douglas E. Bunnell, Marion, Ohio; Joseph A. Gauer, Buchanan, Mich.; R. Bruce Sherer; William F. Scott, both of St. Joseph, Mich.

[73] Assignee: Whirlpool Corporation, Benton Harbor, Mich.

[21] Appl. No.: 928,714

[22] Filed: Jul. 27, 1978

[51] Int. Cl.[2] ..... D06F 37/24

[52] U.S. Cl. ..... 68/23.3; 248/568; 248/603; 248/613

[58] Field of Search ..... 68/23 R, 23.3, 23.6, 68/23.7; 210/364, 367; 248/18, 568, 569, 603, 604, 610, 613

[56] References Cited

U.S. PATENT DOCUMENTS

| | | | |
|---|---|---|---|
| 3,026,700 | 3/1962 | Bochan et al. | 68/23.3 |
| 3,026,701 | 3/1962 | Houser | 68/23.3 |
| 3,132,098 | 5/1964 | Bochan | 68/23.3 X |

FOREIGN PATENT DOCUMENTS

| | | | |
|---|---|---|---|
| 657919 | 2/1963 | Canada | 68/23.3 |

*Primary Examiner*—Philip R. Coe

*Attorney, Agent, or Firm*—Hill, Van Santen, Steadman, Chiara & Simpson

[57] ABSTRACT

A suspension for an automatic clothes washer tub which supports the clothes container, agitator and driving mechanism, comprises a combination skate and rocking support device, the machine frame supporting the device for horizontal movement and the device supporting the tub for rocking movements. Connection of the tub with the device is effected by means of oblique cooperating surfaces on the tub support structure and on the device in generally pyramidal orientation and providing substantial stability for the tub in normal operation of the machine. Biasing means between the tub and the frame normally biases the tub and the device toward an equilibrium position.

19 Claims, 10 Drawing Figures

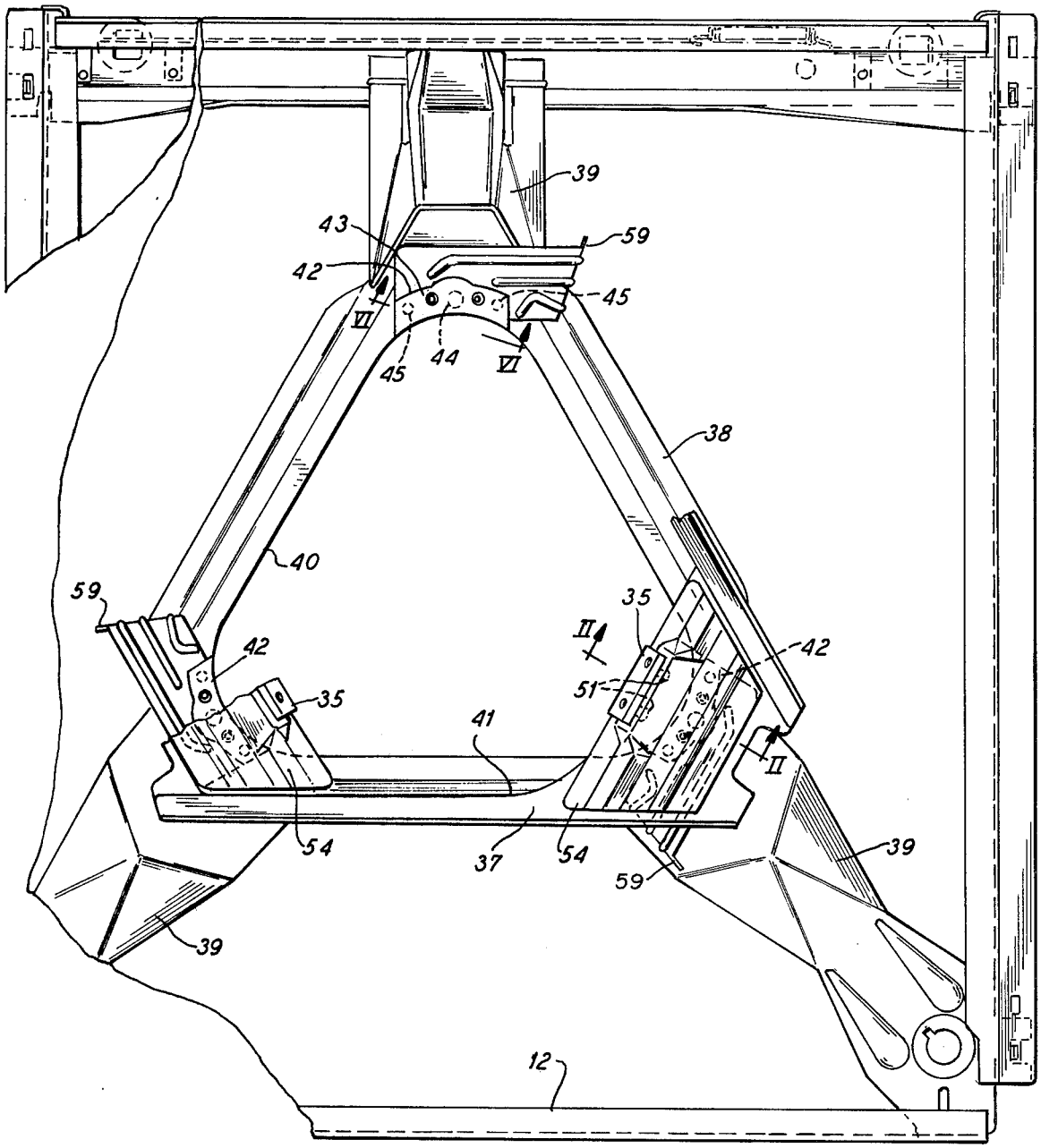
Fig. 5
Fig. 6
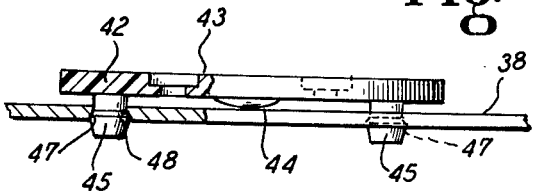

AUTOMATIC WASHER SUSPENSION SYSTEM

BACKGROUND OF THE INVENTION

1. Field of the Invention

This invention relates to new and improved suspension system for automatic clothes washers.

2. Description of the Prior Art

Prior attempts have been made, as represented in U.S. Pat. No. 3,026,701, for example, to provide gimbal support for the tub of a centrifugal machine or automatic washer. That disclosure utilizes a spherical surface on the tub engaging a complementary spherical surface on the supporting member. Such spherical surfaces are costly to produce, and there is difficulty in maintaining satisfactory equilibrium of the tub during normal operation unless the mass center is kept low. Attempts to solve this have resulted in various complications. Excessively strong biasing structures such as springs or other means have been suggested to overcome the relative instability of the spherical gimbal arrangements. Means other than simple biasing stiffness or additions have taken the form, for example, as disclosed in U.S. Pat. No. 3,132,098 of antiprecessional damping means.

Further, in arrangements such as disclosed in the identified patents servicing access to the suspension structures has been difficult, in spite of the sometimes complex structures involved and therefore liability to malfunction and wear.

SUMMARY OF THE INVENTION

It is an object of the present invention to provide a new and improved system for automatic clothes washers which will overcome the disadvantages, drawbacks, inefficiencies, shortcomings, and problems inherent in prior constructions of the type wherein the tub and its supported mechanisms are suspended in a manner to permit load imbalance safety motions of the tub.

Another object of the invention is to stabilize and enhance equilibrium retention in such a suspension system.

According to the principles of the present invention there is provided in an automatic clothes washer having a spin type clothes container within which an agitator is oscillatably mounted, a tub enclosing and supporting the container, means supported substantially centrally on and under the tub for driving the container and agitator, an improved suspension means supporting the tub on a frame in a manner to permit limited rocking and transverse displacement movements during a cycle of operation, the suspension means comprising a combination skate and rocking support device, means supporting the device on the frame under the tub for horizontal movement of the device relative to the frame, generally pyramidally oriented cooperative surfaces on the tub support and on the device supporting the tub support and providing stable support for the tub under normal operating conditions but permitting rocking of the tub relative to the device responsive to tub load imbalances in operation, and resiliently yieldable means for normally biasing the tub and thereby the device toward an equilibrium position.

The means supporting the combination skate and rocking support device on the frame comprise an open-work skeleton frame structure greatly facilitating access to the suspension and the operating mechanism supported thereon, while at the same time providing a compact low profile unit.

BRIEF DESCRIPTION OF THE DRAWINGS

FIG. 5 is a fragmental enlarged plan view showing details involving the supporting frame and the combination skate and gimbal device;

FIG. 6 is an enlarged fragmentary sectional detail view taken substantially along the line VI—VI in FIG. 5;

DESCRIPTION OF A PREFERRED EMBODIMENT

Figure 1:
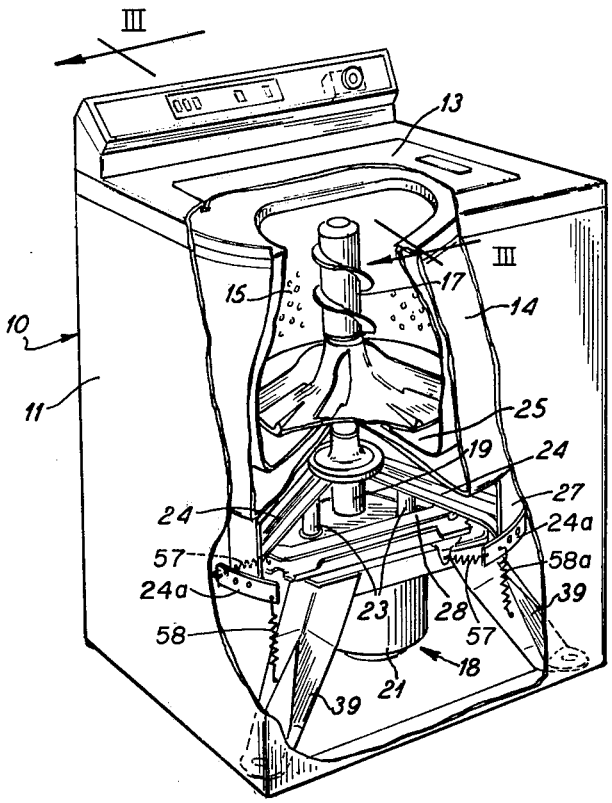
FIG. 1 is a perspective view of an automatic clothes washer embodying the invention.

A laundry appliance 10 comprising an automatic clothes washer embodying the principles of the present invention is depicted in FIG. 1. It comprises the usual cabinet 11 enclosing a machine frame 12. An openable lid 13 in the top of the cabinet permits access into the top of a tub 14 housed within the cabinet. Enclosed and supported within the tub 14 is a clothes container or spin basket 15 within which is oscillatably mounted an agitator 17. Supported substantially centrally on and under the tub 14 are means generally designated 18 for driving the container 15 and the agitator 17 in washing and spin drying operations of a machine cycle. It will be understood, of course, that any preferred washing cycle control system including fluid controlling and cycle controlling hydraulic and electrical means will be provided as is customary for automatic clothes washers of this type.

As to the driving means 18, a vertical drive shaft 18*a* (FIG. 3) is rotatably mounted in a vertical sleeve 19 to which the upper end of a hollow center post 20 of the tub 14 is sealingly attached. Above the post 20, the shaft 18*a* is appropriately operatively attached to the container 15 and the agitator 17. The shaft 18*a* and the enclosing vertical sleeve 19 extend a substantial distance below the tub 14 to driving mechanism including an electrical motor 21 carried by a supporting structure 22 rigidly mounted on and under the tub 14 by means of a plurality, herein three vertical connecting rods 23 each of which is fixedly attached at its lower end to the structure 22 and at its upper end is fixedly secured to a respective arm 24 which extends obliquely generally radially outwardly from the journal sleeve 19 to which the inner end of the arm is fixedly attached by welding to a rigid annular coupling plate 25, having an annular hub 26 encircling and secured by means of welding to the sleeve 19.

Mounting of the tub 14 on the arms 24 is effected by supporting the bottom of the tub on the arms, and fastening the tub to depending outer end portions 24*a* of the arms by means of brackets 27 which are welded to the bottom portion of the tub and extend downwardly therefrom. Attachment of the brackets 27 to the arm portions 24*a* may be by means of bolts 27*a*, whereby the tub may be removed from the arms 24 when desired. In the assembly, the tub and the chassis of which the arms 24 are part comprise a rigid unit.

Means comprising a stabilizer plate 28 provides a rigid connection between the lower end of the sleeve 19, each of the rods 23 and each of the arms 24. A rim flange 29 on the plate 28 is fixedly secured by means of welding 30 (FIG. 4) to each of the arms 24. Means for connecting the plate 28 to the sleeve 19 comprise a central annular depending collar 31 on the plate 28 secured as by welding to the lower end portion of sleeve 19. Respective annular collars 32 on the plate 28 have the rods 24 extending therethrough and are welded to the rods. This provides a rigid carriage or chassis for the tub 14, and since the tub 14 is fixedly secured to the arms 24, a unitary structure is provided in which it can be stated either that the tub is supported by the chassis or that the various parts of the chassis and the associated mechanisms are supported by the tub. In the efficient three point suspension arrangement shown, the three arms 24 and related structure are symmetrically spaced about the journal sleeve 19. In preferred construction, the plates 25 and 28, and the arms 24 are formed up rigidly from suitable gauge sheet metal.

In addition to its important function as part of the structural elements of the chassis for the tub 14, the plate 28 serves as part of the suspension means supporting the tub on the frame 12 in a manner to permit rocking and transverse displacement movements of the tub during a cycle of operation. To this end, the plate 28 is provided with generally pyramidally oriented supporting surfaces 33 FIGS. 2, 3 and 4), in this instance comprising three such surfaces symmetrically arranged in alignment with the arms 24 and obliquely disposed in an upwardly and outwardly flaring manner to face generally downwardly. Each of the surfaces 33 is, in effect, adjacently backed up by one of the posts or rods 23. In addition each of the surfaces 33 is reinforced by strut-like panel portions 34 which connect the sides of each of the portions of the plate providing the surfaces 33 with the sides of the companion surface 33 areas or portions of the plate. The continuous marginal flange 29 also contributes to the rigidity of the structure providing the surfaces 33.

Cooperatively related to the surfaces 33 are generally pyramidally oriented surfaces 35 on a combination skate and rocking support device 37 which is supported on the frame 12 by means of a base plate 38 mounted rigidly on tripod legs 39 extending upwardly and inwardly from fixed attachment to the base portion of the frame 12. An ample generally triangular clearance opening 40 in the base plate 38 permits the operating mechanism 18 of the machine to depend freely through the plate. For the same purpose, the skate plate 37 has a generally triangular clearance opening 41, which is desirably larger than the base plate clearance opening 40. Not only the skate plate 37 but also the base plate 38 and the legs 39 are adapted to be formed up from suitable gauge heavy sheet metal.

Horizontal movement of the skate and rocking support device plate 37 in all directions on and relative to the base plate 38 is permitted by mounting of the plate 37 on limited area friction pad means 42 (FIGS. 2, 5, 6 and 9) carried by the base plate 38 in alignment with the legs 39. In a desirable form, the pad means 42 comprise castings made from a suitable low friction polymeric material such as polytetrafluoroethylene and providing a body having a flat top surface 43, a central depending preferably semi-spherical bearing surface 44; and position retaining depending lugs 45 spaced laterally relative to the surface 44 and extending downwardly through apertures 47 provided therefor in the plate 38 and defined by generally downwardly facing oblique shoulder surfaces cooperating with complementary shoulder surfaces 48 on the lugs 45 to retain the pad members 42 in place. Bearing surface 44 engages plate 38 and is designed to bias pad 42 upwardly to assure a tight fit between lugs 45 and plate 38.

Figure 2:
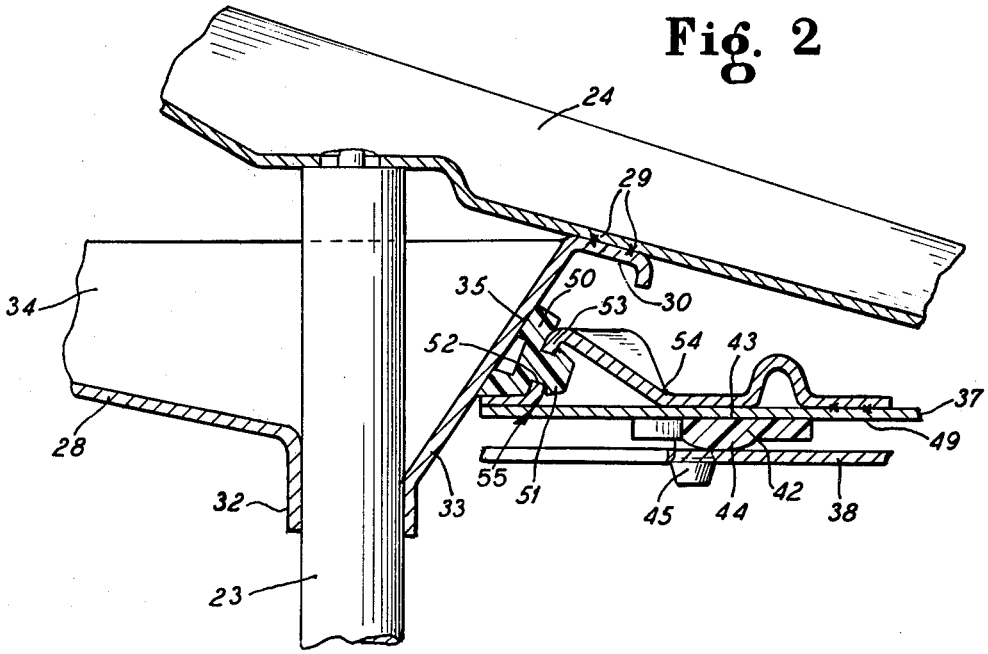
FIG. 2 is an enlarged fragmentary sectional detail view taken substantially along the line II—II of FIG. 5.

On its undersurface, as shown in FIG. 2, the skate and rocking support device plate 37 has respective flat downwardly facing bearing surfaces 49 which engage in frictionally slidable relation on the respective upper bearing surfaces 43 of the supporting pad members 42.

In a preferred form, the oblique supporting surfaces 35 on the skate and rocking support device are provided by pad members 50 which may also be polytetrafluoroethylene castings. Each of the members 50 has a block-like body of substantial mass provided on its back side with a spaced pair of shouldered anchoring lugs 51 which are received through respective anchor holes 52 in a backup panel 53 of a rigid mounting panel bracket member 54 secured as by means of welding onto the top of the plate 37. As will be best observed in FIG. 2, each of the mounting members 54 provides a rigid seat 55 for the associated pad member 50, the seat 55 being of a structure and orientation relative to the adjacent inner edge of the plate 37 to permit a substantial portion of the pad 50 to project inwardly beyond the lower edge defining the seat 55 and the adjacent edge of the plate 37 to have the rocking support supporting surfaces 35 amply clear of all metal supporting structure for the members 50 to avoid interference with the rocking support surfaces 33 in operation.

As a result of the generally pyramidally oriented supporting surfaces 33 cooperating with the complementary pyramidally oriented supporting surfaces 35 on the skate and rocking support device, stable support for the tub 14 under normal operating conditions is provided, but rocking of the tub 14 relative to the rocking support and skate plate 37 responsive to tub load imbalances in operation is permitted by sliding of the rocking support surfaces 33 on the rocking support surfaces 35, and horizontal movement is permitted by sliding of the plate 37 on the pads 42.

Figure 3:
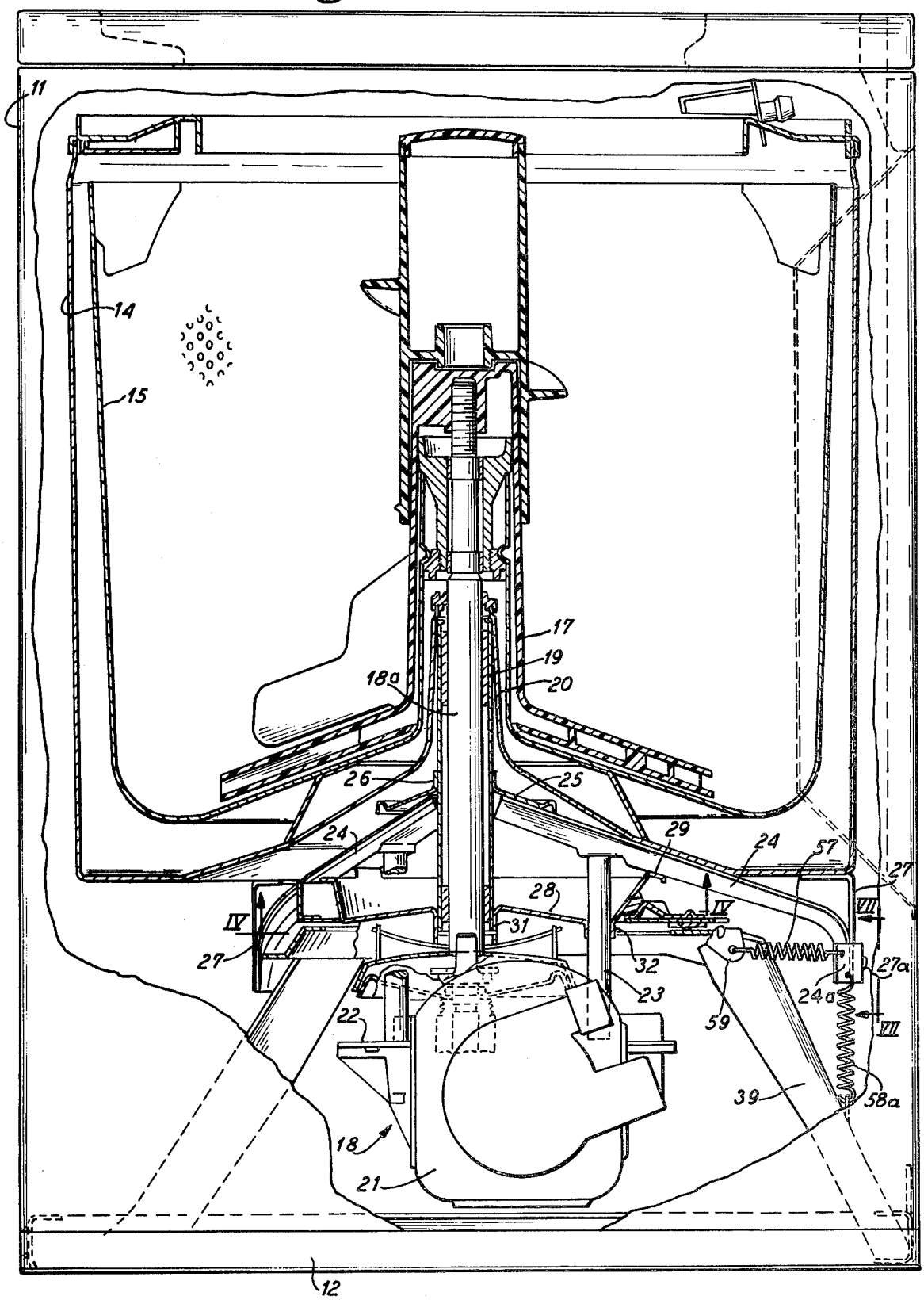
FIG. 3 is an enlarged vertical sectional detail view taken substantially along the line III—III in FIG. 1.
Figures 4, 7, 8:
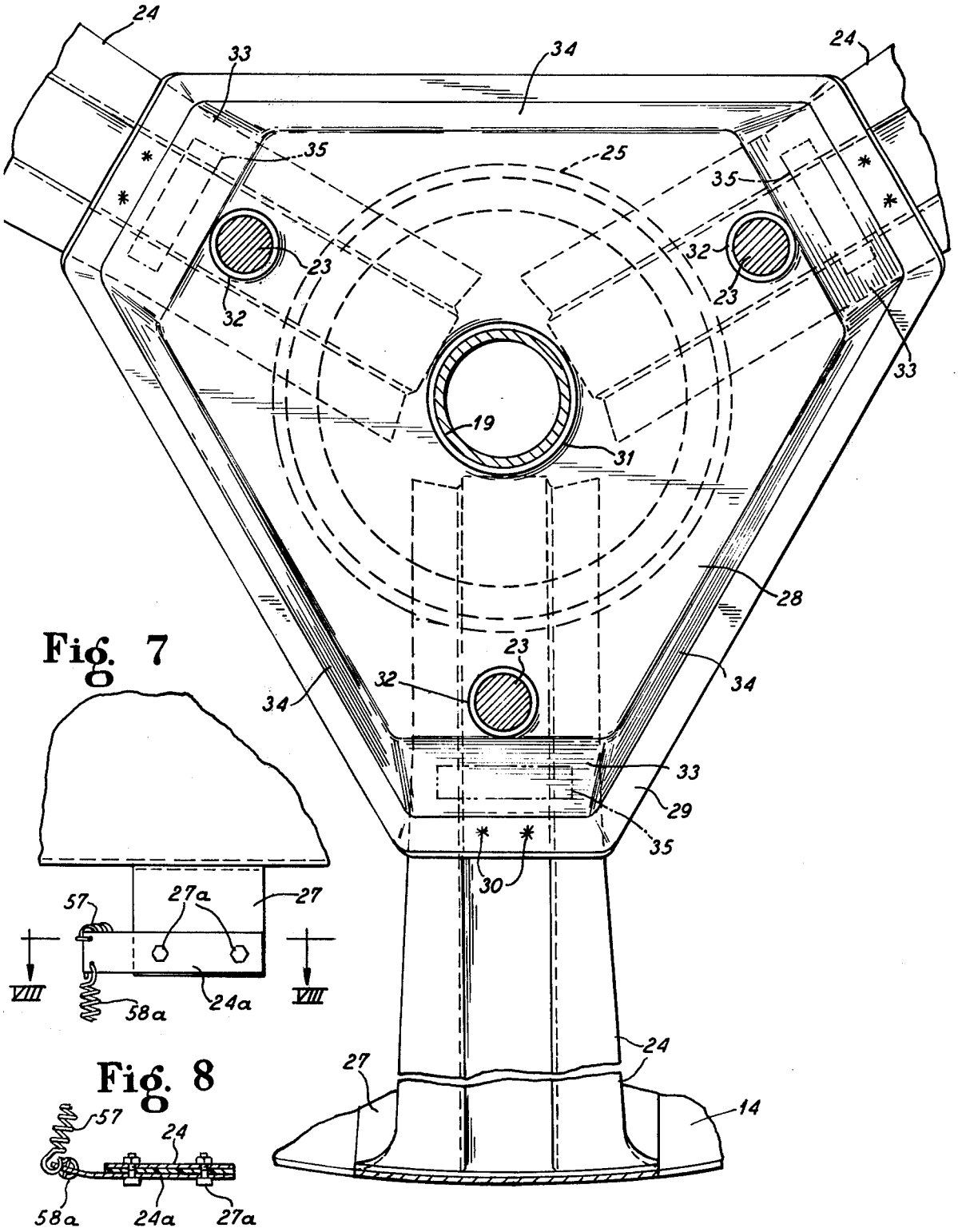
FIG. 4 is an enlarged fragmentary horizontal sectional and underside plan view taken substantially along the line IV—IV in FIG. 3.
FIG. 7 is a fragmental enlarged detail view taken at VII—VII in FIG. 3.
FIG. 8 is an enlarged sectional view taken along line VIII—VIII in FIG. 7.
Figure 9:
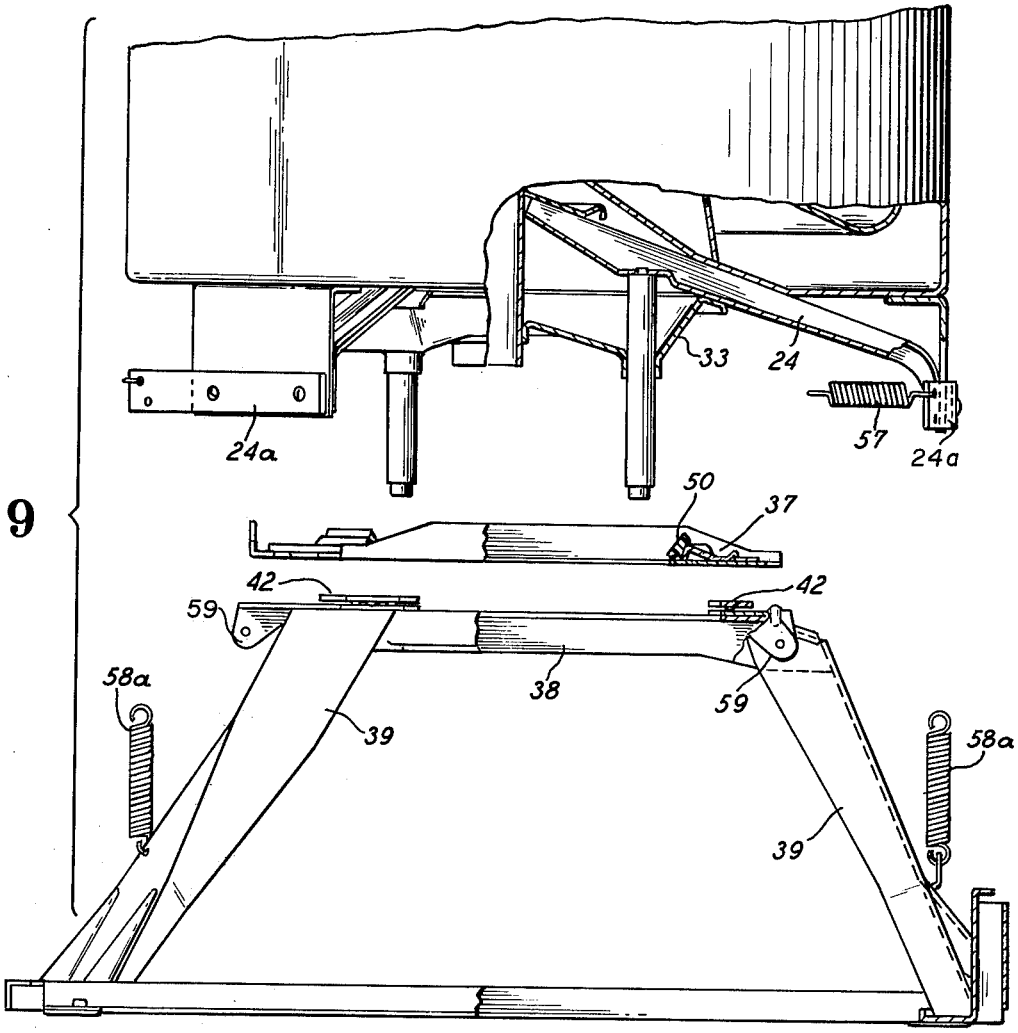
FIG. 9 is an exploded fragmental view showing the respective relative positions of the support, skate plate and upper machine structure of the invention.
Figure 10:
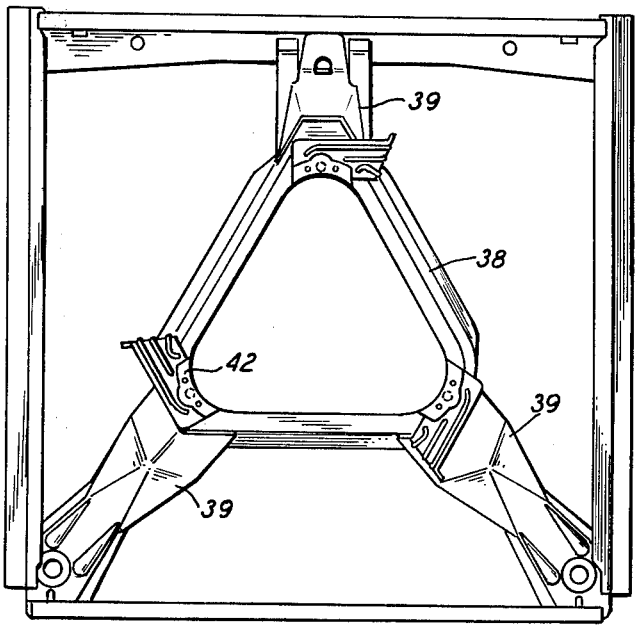
FIG. 10 is a plan view of the lower support structure of the invention.

Means for resiliently yieldably normally biasing the tub 14 and thereby the skate and rocking support device comprising the plate 37 toward an equilibrium position comprise a set of three tension springs 57 (FIGS. 1, 7 and 8) and a set three of counterbalance springs comprising a left-hand front spring 58 and a right-hand front spring 58*a* (FIGS. 1 and 9) as well as a rear spring 58*a* (FIGS. 3, 7 and 9). In a preferred arrangement each of the springs 57 is adapted to provide a component of generally inward bias and for this purpose is connected at one end to an outwardly projecting end portion of a bracket 24*a* bolted to an arm 24 and connected at its opposite end under tension to the base plate 38 provided for this purpose with anchoring means in the form of a depending anchor ear 59. The counterbalancing springs 58 and 58*a* are connected at one end to the respective associated bracket 24*a* and at their opposite ends to the respective associated frame leg 39 in a manner to provide a component of downward biasing tension. The spring 58 (FIG. 1) exerts which may be heavier than springs 58*a;* a static counterbalancing force to compensate for an off balance caused primarily by the weight and mounting location of motor 21. The springs 58*a* counterbalance a dynamic off balance which occurs during the spin portion of the machine cycle. Through this arrangement symmetrical biasing of the tub 14 toward the equilibrium position is assured at all times and rocking and horizontal movements of the tub 14 are limited to reasonable and safe magnitude.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. In an automatic clothes washer having a spin type clothes container within which an agitator is oscillatably mounted, a tub enclosing and supporting the container, means supported substantially centrally on and under the tub for driving the container and agitator, and suspension means supporting the tub in a manner to permit limited rocking and transverse displacement movements of the tub during a cycle of operation, the improvement in the suspension means comprising:

a combination skate and rocking support device;

support means supporting said device under said tub for horizontal movement of said device relative to said support means;

generally pyramidally oriented cooperative surfaces on said tub and on said device for supporting said tub on said device and for providing stable support for the tub under normal operating conditions but permitting rocking of the tub relative to the device responsive to tub load imbalances in operation;

and resiliently yieldable means for normally biasing said tub and thereby said device toward an equilibrium position.

2. A washer according to claim 1, wherein said skate and gimbal device comprises a skate plate, and said support means comprises a frame housing a base plate and means on said base plate providing limited area supporting surfaces on which said skate plate is horizontally movably supported.

3. A washer according to claim 2, in which said limited area supporting surface means comprise low friction cast polymer pads supported on said base plate.

4. A washer according to claim 1, wherein said pyramidally oriented surfaces on said device comprise low friction polymer cast pad members supported by said device.

5. A washer according to claim 4, wherein said device comprises a skate plate and means on said skate plate providing seats for said pad members.

6. A washer according to claim 1, wherein said tub has a chassis and said pyramidally oriented surfaces on the tub are on a part of said chassis.

7. A washer according to claim 6, wherein said chassis part comprises a combination structural and rocking support plate having thereon said pyramidally oriented surfaces on the tub.

8. A washer according to claim 1, wherein said tub is mounted on a chassis comprising circumferentially spaced and radially extending arms, means connecting said arms to said tub, and means attached to said arms providing said pyramidally oriented surfaces on said tub.

9. A washer according to claim 8, wherein said support means comprises a plurality of generally upstanding legs, means on said legs providing support for said skate and rocking support device, and said resiliently yieldable means comprising biasing springs connected to said arms and to said legs.

10. A washer according to claim 9, wherein said biasing springs provide components of generally radially inward biasing spring spring force.

11. In an automatic clothes washer having a spin type clothes container within which an agitator is oscillatably mounted, a tub enclosing and supporting the container, means supported substantially centrally on and under the tub for driving the container and agitator, and suspension means supporting the tub on a frame in a manner to permit limited rocking and transverse displacement movements of the tub during a cycle of operation, the improvement in the suspension means comprising:

a chassis on and under the tub and having a plurality of circumferentially spaced radially extending arms underlying and supportingly related to the bottom of the tub;

means securing the tub to said arms;

upstanding frame legs aligned with said arms;

and combination skate and rocking support means supporting the arms on the upper ends of said legs;

said legs providing an open framework facilitating access to said driving means.

12. A washer according to claim 11, comprising means securing radially outer ends of said arms to said tub.

13. A washer according to claim 11, including a base plate fixed to the upper ends of said legs and having a substantial opening through which said driving means project freely, and said skate and rocking support means comprise a skate plate and means supporting the skate plate horizontally movably on said base plate, said skate plate having a substantial opening generally matching the opening in the base plate for projection of the driving means through the openings.

14. A washer according to claim 13, wherein said skate plate and said arms have respective means fixed thereto providing generally pyramidally oriented cooperative surfaces providing stable support for the chassis and tub under normal operating conditions but permitting rocking of the chassis and tub responsive to tub load imbalances in operation of the washer.

15. A washer according to claim 11, including structure suspended from said arms and providing support for said driving means.

16. A washer according to claim 11, including resiliently yieldable means connected between said arms and said legs and normally biasing said chassis and tub toward an equilibrium position.

17. A washer according to claim 16, wherein said biasing means comprise tension springs effecting components of horizontal and vertical biasing tension.

18. A washer according to claim 16, wherein at least some of said biasing tension compensates for static imbalances and at least some of said biasing tension compensates for dynamic imbalances within the washer and suspension means.

19. In an automatic clothes washer having a tub means for agitating and centrifuging a clothes load, drive means mounted on and under said tub means for providing a driving source for said agitating and centrifuging, and suspension means supporting the tub means in a manner to permit limited rocking and transverse displacement movements of the tub means during a cycle of operation, the improvement in the suspension means comprising:

a skate plate;

a base plate supporting said skate plate under said tub for horizontal movement of said skate plate relative to said base plate;

generally pyramidally oriented cooperative surfaces on said tub means and on said skate plate for supporting said tub means on said skate plate and for providing stable support for the tub means under normal operating conditions but permitting rocking of the tub means relative to the skate plate responsive to tub load imbalances in operation;

and resiliently yieldable means for normally biasing said tub means and thereby said skate plate toward an equilibrium position.

* * * * *

UNITED STATES PATENT AND TRADEMARK OFFICE

CERTIFICATE OF CORRECTION

PATENT NO. : 4,174,622

DATED : November 20, 1979

INVENTOR(S) : Douglas E. Bunnell et al.

It is certified that error appears in the above-identified patent and that said Letters Patent are hereby corrected as shown below:

Claim 2, line 46, after "frame" delete "housing" and substitute --having--.

Claim 10, line 13, after "spring" erase the second occurrence of "spring".

Signed and Sealed this

*Twenty-fifth* Day of *March 1980*

[SEAL]

*Attest:*

SIDNEY A. DIAMOND

*Attesting Officer*

*Commissioner of Patents and Trademarks*